US010618315B2

(12) United States Patent
Hamada

(10) Patent No.: US 10,618,315 B2
(45) Date of Patent: Apr. 14, 2020

(54) MEDIUM SUPPORT UNIT, PRINTING APPARATUS, AND ATTACHMENT METHOD OF FRICTION MEMBER

(71) Applicant: SEIKO EPSON CORPORATION, Tokyo (JP)

(72) Inventor: Nobuhiko Hamada, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 114 days.

(21) Appl. No.: 15/903,936

(22) Filed: Feb. 23, 2018

(65) Prior Publication Data

US 2018/0244074 A1 Aug. 30, 2018

(30) Foreign Application Priority Data

Feb. 24, 2017 (JP) ..... 2017-033551

(51) Int. Cl.
*B41J 3/407* (2006.01)
*B41J 11/06* (2006.01)

(52) U.S. Cl.
CPC ..... *B41J 3/4078* (2013.01); *B41J 11/06* (2013.01); *B65H 2701/174* (2013.01)

(58) Field of Classification Search
CPC .... B41J 3/4078; B41J 11/06; B65H 2701/174
See application file for complete search history.

(56) References Cited

U.S. PATENT DOCUMENTS

2004/0189776 A1 9/2004 Niimi et al.
2009/0265972 A1* 10/2009 Chang ..... A47G 1/06 40/771
2015/0331362 A1* 11/2015 Azeyanagi ..... G03G 15/0898 399/102

FOREIGN PATENT DOCUMENTS

JP 2004-291430 A 10/2004

* cited by examiner

*Primary Examiner* — Justin Seo
(74) *Attorney, Agent, or Firm* — Workman Nydegger

(57) ABSTRACT

A medium support unit includes a support portion on which it is possible to set a medium in a setting direction that runs parallel to a support surface, and a friction member that is attached to the support portion, in which the friction member has an incision formation portion at a position that corresponds to a corner portion, and the incision formation portion that covers the corner portion positioned on an upstream side than the center in the setting direction has a first cover portion and a second cover portion positioned on a downstream side than the setting direction than the first cover portion, the first cover portion overlaps with the second cover portion such that an end portion of the first cover portion on the downstream side in the setting direction covers an end portion of the second cover portion on the upstream side in the setting direction.

15 Claims, 11 Drawing Sheets

MEDIUM SUPPORT UNIT, PRINTING APPARATUS, AND ATTACHMENT METHOD OF FRICTION MEMBER

BACKGROUND

1. Technical Field

The present invention relates to a medium support unit, a printing apparatus, and an attachment method of friction member.

2. Related Art

In the related art, medium support units that cause a medium to be supported by a support portion are used. Among such medium support units, a medium support unit having a configuration in which a medium is fixed to a support portion (so as to immobilize a medium) by a friction member is used.

For example, JP-A-2004-291430 discloses a fabric printing apparatus (a printing apparatus provided with a medium support unit) having a configuration in which a fabric, as a medium, is fixed to a platen, as a support portion, by pasting a cotton cloth, as a friction member, onto a central region of the platen and using a frictional force of the cotton cloth.

A medium support unit such as that disclosed in JP-A-2004-291430, which has a configuration in which a medium is fixed to a support portion by a friction member, can firmly fix the medium to the support portion by the friction member. However, when a medium is set on the support portion, there are cases in which the friction member becomes caught, for example in corner portions of the support portion, due to the medium coming into contact with the friction member (in particular, an end portion of the friction member) with a strong frictional force and the friction member becomes separated.

SUMMARY

An advantage of some aspects of the invention is that a medium is firmly fixed to a support portion by a friction member and the friction member is prevented from becoming separated during setting of the medium on the support portion.

According to an aspect of the invention, there is provided a medium support unit that supports, on a support surface, a medium on which printing is to be performed by a printing apparatus, the medium support unit is provided with a support portion that has the support surface and on which it is possible to set the medium in a setting direction that runs parallel to the support surface, and a friction member, which is a member having a higher static friction coefficient with respect to the medium than the support surface and is attached to the support portion to cover the support surface, the support portion has a corner portion at which, when viewed from the support surface side, two different sides intersect, the friction member has, at a position that corresponds to the corner portion, an incision formation portion in which three or more incisions are made, the incision formation portion that covers the corner portion positioned further on an upstream side than a center in the setting direction has a first cover portion, formed between adjacent incisions, and a second cover portion positioned further on a downstream side in the setting direction than the first cover portion and formed between adjacent incisions, and the first cover portion overlaps with the second cover portion such that an end portion of the first cover portion on the downstream side in the setting direction covers an end portion of the second cover portion on the upstream side in the setting direction.

In this case, the incision formation portion that covers the corner portion positioned further on the upstream side in the setting direction than the center is overlapped so that the end portion of the first cover portion on the downstream side in the setting direction covers the end portion of the second cover portion on the upstream side in the setting direction. That is, in a corner portion that is positioned further on the upstream side in the setting direction than the center, the end portion of a cover portion on the upstream side in the setting direction formed between incisions is covered. At the corner portion positioned further on the upstream side than the center in the setting direction, a medium is likely to come into contact with the friction member with a strong frictional force during setting of the medium in the support portion, and therefore, the end portion of the cover portion, which is formed between incisions, on the upstream side in the setting direction is particularly likely to become caught or separated due to the medium moving in the setting direction. However, as a result of adopting such a configuration, the end portion of the friction member is unlikely to become caught on a medium even if the medium is moved in the setting direction. Therefore, it is possible to firmly fix a medium to the support portion by the friction member and it is possible to prevent the friction member from becoming separated during setting of the medium in the support portion.

In this instance, rather than referring exclusively to directly causing a medium to be supported on a support surface, the term "supports on the support surface" has a meaning that includes disposing another member, or the like, on the support surface and indirectly (without coming into direct contact) supporting a medium.

In addition, the term "corner portion" has a meaning that includes arc-like corners (round corners) and portions on which chamfering has been carried out.

In the medium support unit, it is preferable that the incision formation portion that covers the corner portion positioned further on the downstream side than the center in the setting direction have a third cover portion formed between adjacent incisions, and a fourth cover portion positioned further on the downstream side in the setting direction than the third cover portion and formed between adjacent incisions, and the fourth cover portion overlap with the third cover portion such that an end portion of the fourth cover portion on the upstream side in the setting direction covers an end portion of the third cover portion on the downstream side in the setting direction.

In this case, in the incision formation portion that covers the corner portion positioned further on the downstream side than the center in the setting direction, the fourth cover portion overlaps with the third cover portion such that the end portion of the fourth cover portion on the upstream side in the setting direction covers the end portion of the third cover portion on the downstream side in the setting direction. That is, the configuration of the incision formation portion is symmetric in the setting direction with the center in the setting direction as a reference. Therefore, in a case in which the support portion is constituted having a symmetrical structure in the setting direction, or the like, regardless of the direction in which the support portion is set in the setting direction (even if the support portion is set with the upstream side and the downstream side reversed), it is possible to firmly fix a medium to the support portion by the friction member and it is possible to prevent the friction member from becoming separated during setting of the medium in the support portion.

In the medium support unit, it is preferable that the incision formation portion that covers the corner portion positioned further on the downstream side than the center in the setting direction have a third cover portion formed between adjacent incisions, and a fourth cover portion positioned further on the downstream side in the setting direction than the third cover portion and formed between adjacent incisions, and the third cover portion overlap with the fourth cover portion such that an end portion of the third cover portions on the downstream side in the setting direction covers an end portion of the fourth cover portion on the upstream side in the setting direction.

In this case, in the incision formation portion that covers the corner portion positioned further on the downstream side than the center in the setting direction, a third cover portion overlaps with the fourth cover portion such that the end portion of the third cover portion on the downstream side in the setting direction covers the end portion of the fourth cover portion on the upstream side in the setting direction. Therefore, at a corner portion positioned further on the downstream side than the center in the setting direction, it is also possible to effectively prevent the friction member from becoming separated during setting of a medium in the support portion.

In the medium support unit, it is preferable that a fixing portion that fixes the friction member in an attachable and detachable manner be provided to the support portion.

In this case, since the fixing portion that fixes the friction member in an attachable and detachable manner is provided to the support portion, it is possible to easily perform cleaning, replacement, and the like, of the friction member by attaching and detaching the friction member.

In the medium support unit, it is preferable that the fixing portion be provided on a rear surface opposite to the support surface.

In this case, since the fixing portion is provided on a rear surface on a side opposite to the support surface, it is possible to prevent a medium from becoming caught and the friction member from becoming separated at the fixing portion, in the vicinity of the fixing portion, or the like.

In the medium support unit, it is preferable that the incision formation portion be formed by making incisions in a radial manner.

In this case, since the incision formation portion is formed by making incisions in a radial manner, it is possible to suitably form a configuration in which the first cover portion overlaps with the second cover portion such that the end portion of the first cover portion on the downstream side in the setting direction covers the end portion of the second cover portion on the upstream side in the setting direction.

In the medium support unit, it is preferable that a stepped portion be formed in at least one portion of the support portion in the periphery of the support surface by making a step in the support surface in order to bear a frame portion that presses the medium, and that the friction member cover the stepped portion in such a way that an inclined surface is formed above the stepped portion.

In this case, the stepped portion for bearing a frame portion that presses the medium is formed in at least one portion of the support portion in the periphery of the support surface. Therefore, it is possible to use the frame portion that presses the medium according to necessity. In addition, the friction member covers the stepped portion so that an inclined surface is formed above the stepped portion. That is, the inclined surface is formed in the periphery of the support surface. The periphery of the support surface is an area in which the medium is likely to rise from the support portion, but it is possible to prevent rising of the medium as a result of the inclined surface being formed in the periphery of the support surface.

According to another aspect of the invention, there is provided a printing apparatus provided with the medium support unit, and a printing section that performs printing on the medium supported by the medium support unit.

In this case, it is possible to print with a medium firmly fixed to the support portion by the friction member and it is possible to prevent the friction member from becoming separated during setting of the medium in the support portion.

According to still another aspect of the invention, there is provided an attachment method of a friction member in a medium support unit that supports, on a support surface, a medium on which printing is to be performed by a printing apparatus, the medium support unit being provided with a support portion that has the support surface and on which it is possible to set the medium in a setting direction that runs parallel to the support surface, and a friction member, which is a member having a higher static friction coefficient with respect to the medium than the support surface and is attached to the support portion to cover the support surface, in which the support portion has a corner portion at which, when viewed from the support surface side, two different sides intersect, and the friction member has, at a position that corresponds to the corner portion, an incision formation portion in which three or more incisions are made, the method including, when covering the corner portion positioned further on the upstream side than the center in the setting direction by the incision formation portion of the friction member, overlapping a first cover portion formed between adjacent incisions with a second cover portion positioned further on the downstream side in the setting direction than the first cover portion and formed between adjacent incisions such that an end portion of the first cover portion on the downstream side in the setting direction covers an end portion of the second cover portion on the upstream side in the setting direction.

In this case, at the incision formation portion that covers the corner portion positioned further on the upstream side than the center in the setting direction, the first cover portion overlaps the second cover portion such that the end portion of the first cover portion on the downstream side in the setting direction covers the end portion of the second cover portion on the upstream side in the setting direction. That is, in a corner portion positioned further on the upstream side than the center in the setting direction, the end portion of a cover portion on the upstream side in the setting direction formed between incisions is covered. At the corner portion positioned further on the upstream side than the center in the setting direction, a medium is likely to come into contact with the friction member with a strong frictional force during setting of the medium in the support portion, and therefore, the end portion of the cover portion, which is formed between incisions, on the upstream side in the setting direction is particularly likely to become caught or separated due to the medium moving in the setting direction. However, as a result of the friction member being attached by using such a method, the end portion of the friction member is unlikely to become caught on a medium even if the medium is moved in the setting direction. Therefore, it is possible to firmly fix a medium to the support portion by the friction member and it is possible to prevent the friction member from becoming separated during setting of the medium in the support portion.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a printing apparatus 1 according to an embodiment of the invention will be described in detail with reference to the appended drawings.

Figure 1:
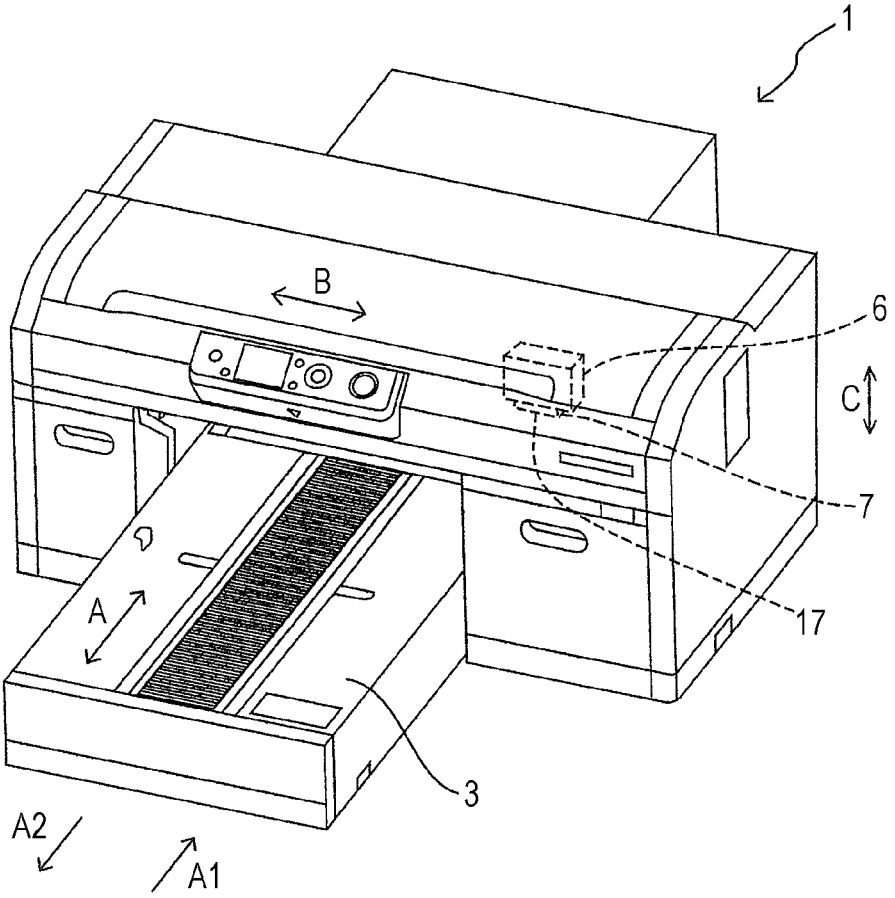
FIG. 1 is a schematic perspective view that represents a printing apparatus according to an embodiment of the invention.
Figure 2:
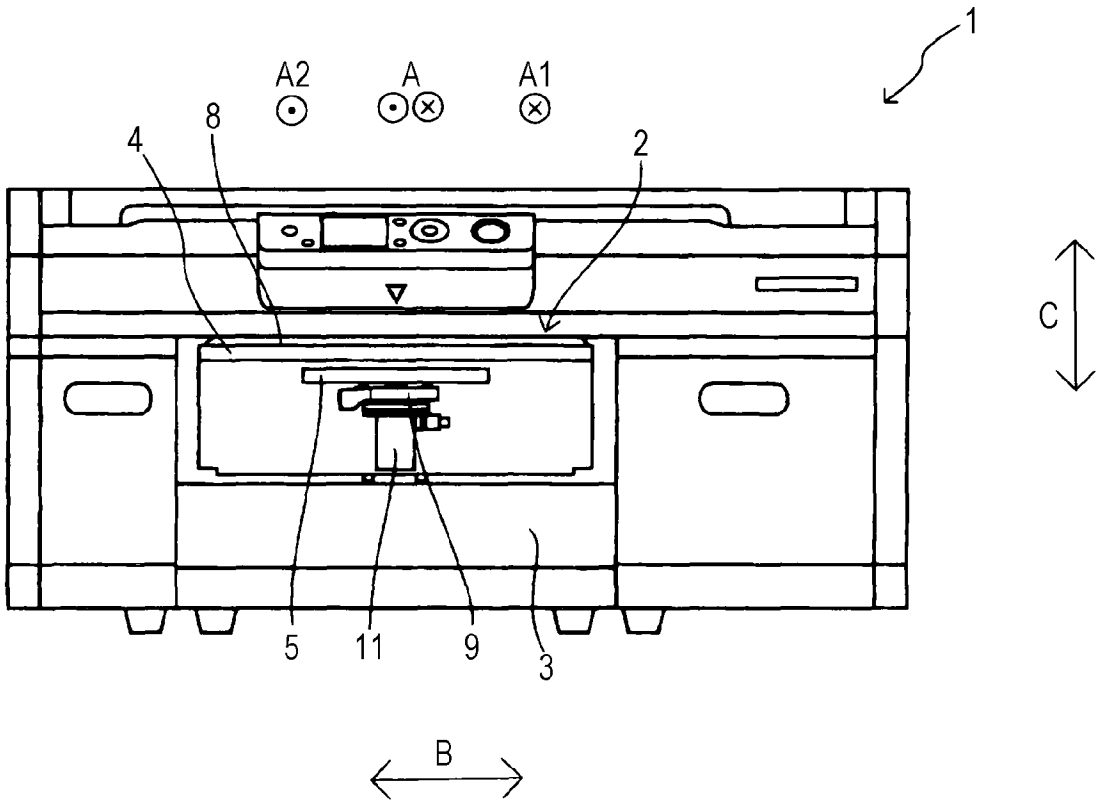
FIG. 2 is a schematic front view that represents the printing apparatus according to the embodiment of the invention.
Figure 3:
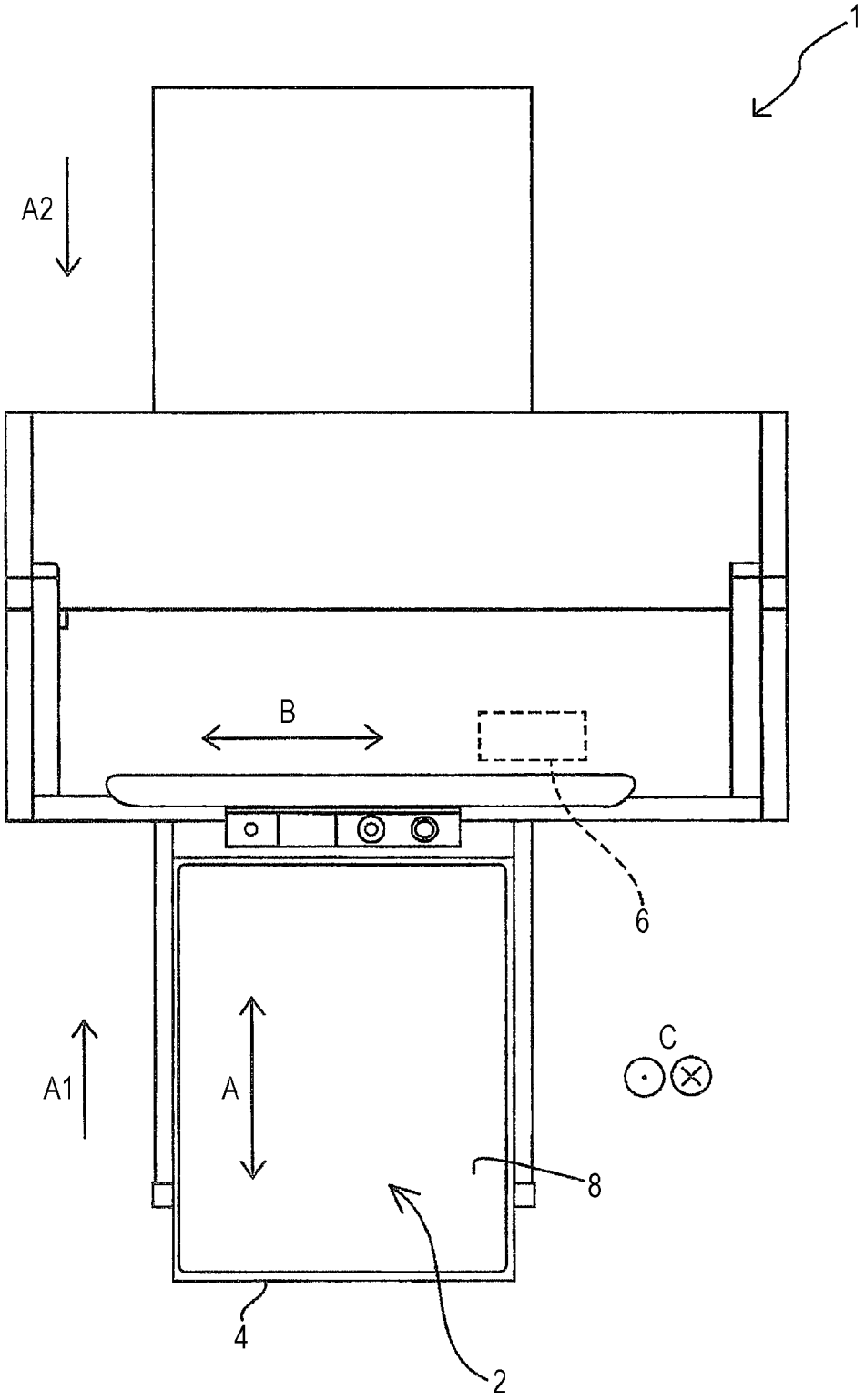
FIG. 3 is a schematic plan view that represents the printing apparatus according to the embodiment of the invention.

FIG. 1 is a schematic perspective view of the printing apparatus 1 according to the present embodiment, and represents a state in which a medium support unit 2 is in a printing start position. In addition, FIG. 2 is a schematic front view of the printing apparatus 1 of the present embodiment. Further, FIG. 3 is a schematic plan view of the printing apparatus 1 of the present embodiment, and represents a state in which the medium support unit 2 is in a setting position of a medium. Additionally, FIGS. 1 to 3 represent a portion of the constituent members in a simplified manner.

The printing apparatus 1 is provided with the medium support unit 2. The medium support unit 2 is provided with a tray 4 as a support portion, and the tray 4 has a support surface 8 that supports a medium. Further, the medium support unit 2 moves in a movement direction A in a state in which a medium is supported by the support surface 8 of the tray 4.

In addition, the printing apparatus 1 is provided with a medium transport portion 3 that transports, in the movement direction A, a medium supported by the tray 4. The movement direction A is a direction that includes a direction A1 and a direction A2 that is a direction opposite the direction A1. Additionally, the printing apparatus 1 of the present embodiment has a configuration in which it is possible to print on a medium having cylindrical sections such as a T-shirt, and a setting direction of such a medium into the medium support unit 2 (the tray 4) corresponds to the direction A1. Therefore, hereinafter description will be given treating the setting direction of a medium as a setting direction A1.

In addition, the medium support unit 2 is mounted on a stage 5 in an attachable and detachable manner. In this instance, an attachment and detachment direction C of the medium support unit 2 to the stage 5 is a vertical direction in the printing apparatus 1 of the present embodiment. The medium support unit 2 moves together with the stage 5 in a direction (the vertical direction) that runs parallel to the attachment and detachment direction C as a result of the lever 9 being caused to rotate. Additionally, as represented by FIG. 2, a lever 9 is provided to an arm portion 11. Furthermore, as a medium, in addition to a medium having cylindrical portions such as a T-shirt, it is possible to use a medium having a different shape to the shape indicated above, or media of various materials such as a textile (a fabric, a cloth, or the like), paper, or a vinyl chloride resin.

In addition, a printing head 7, as a printing section that is capable of printing on a medium by discharging ink, as an example of a liquid, from a nozzle (not illustrated in the drawings) that is formed on a formation surface 17, is provided inside a main body of the printing apparatus 1. Further, the printing apparatus 1 of the present embodiment forms a desired image by discharging ink from the printing head 7 onto a medium supported by the tray 4 while causing the printing head 7 to reciprocate in a scanning direction B, which intersects the movement direction A, as a result of causing a carriage 6, as a holding portion that holds the printing head 7, to reciprocate in the intersecting direction B.

Additionally, in the printing apparatus 1 of the present embodiment, the front side (lower left direction) in FIG. 1 is a setting position of a medium in the tray 4 (refer to FIG. 3). Further, after the tray 4 in which a medium is set is moved in the direction A1 of the movement direction A up to a printing start position on the far side (the upper right direction) in FIG. 1, printing is performed while moving the tray 4 in the direction A2 of the movement direction A.

Next, the medium support unit 2, which is a main portion of the printing apparatus 1 of the present embodiment will be described.

Figure 4:
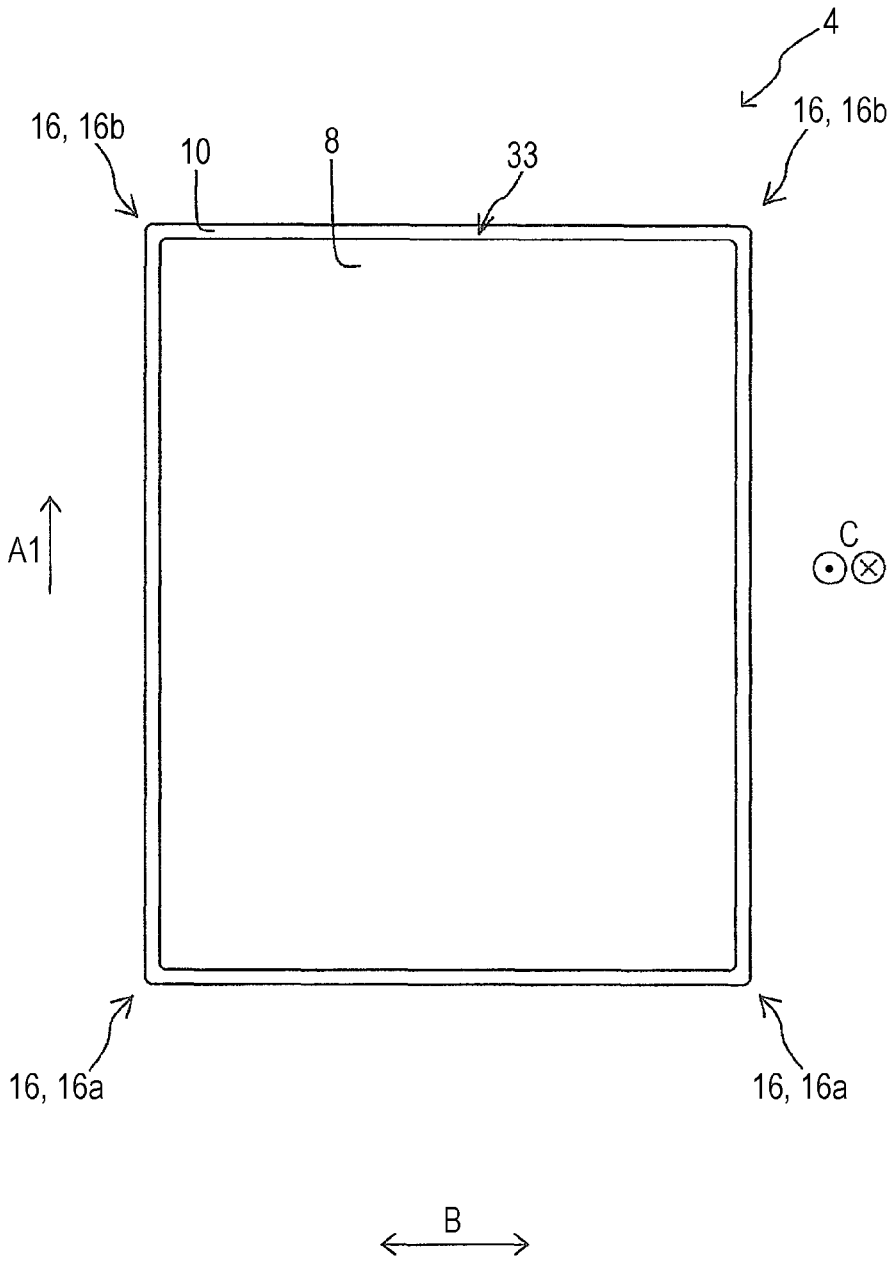
FIG. 4 is a schematic plan view that represents a portion of a medium support unit that can be used by the printing apparatus according to the embodiment of the invention.
Figure 5:
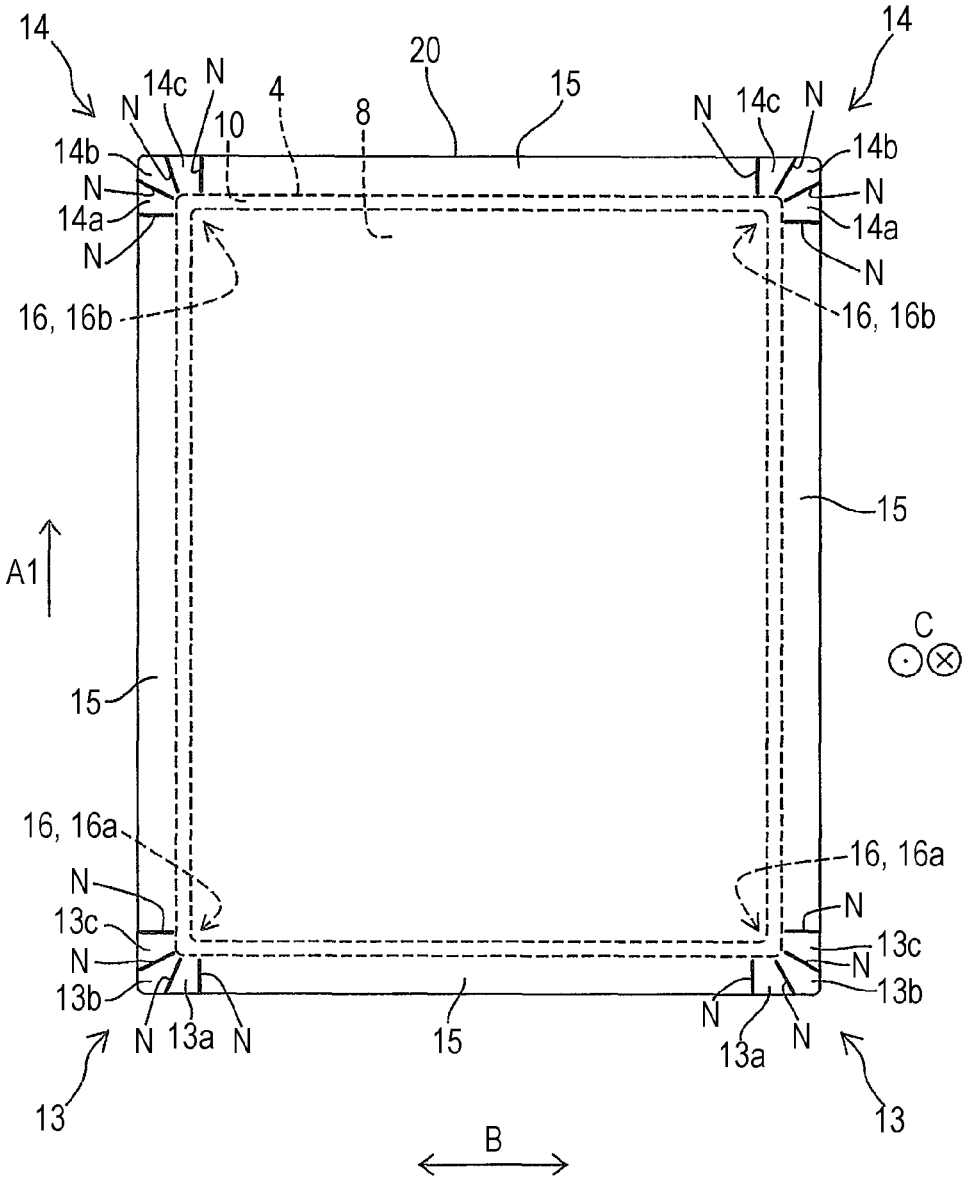
FIG. 5 is a schematic plan view that represents a portion of the medium support unit that can be used by the printing apparatus according to the embodiment of the invention.
Figure 6:
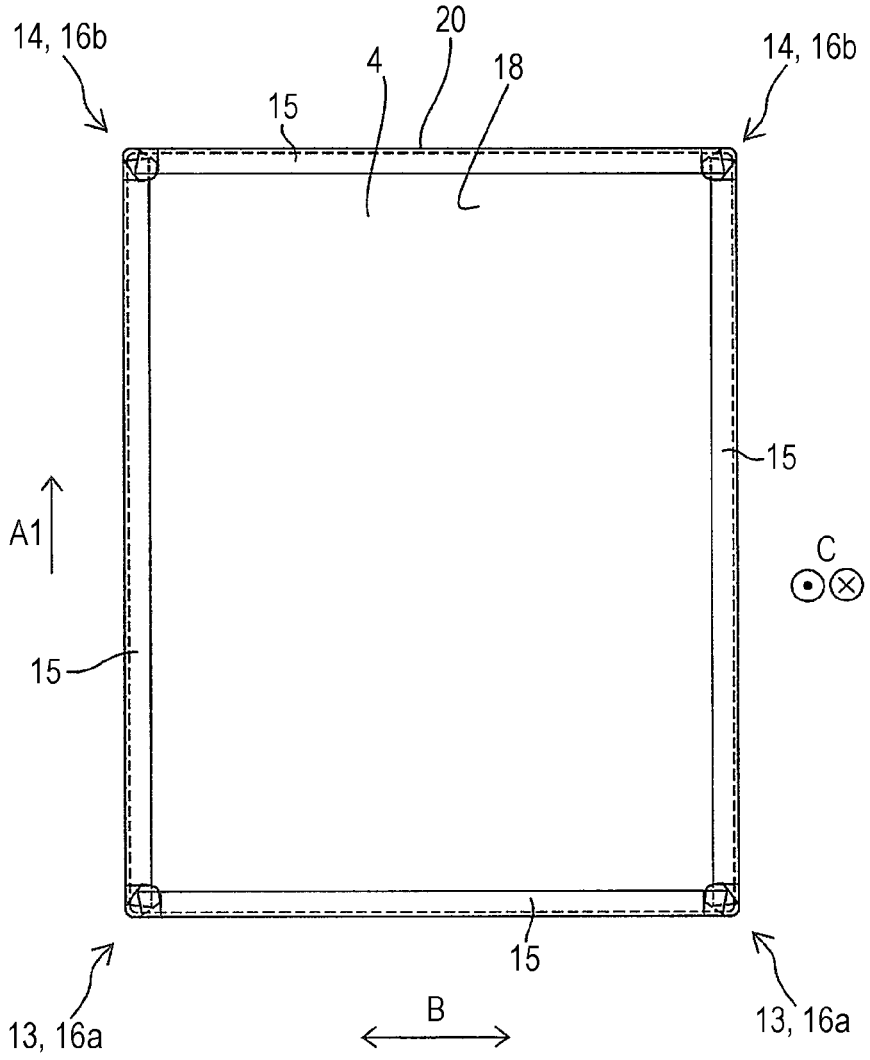
FIG. 6 is a schematic bottom view that represents a portion of the medium support unit that can be used by the printing apparatus according to the embodiment of the invention.
Figure 7:
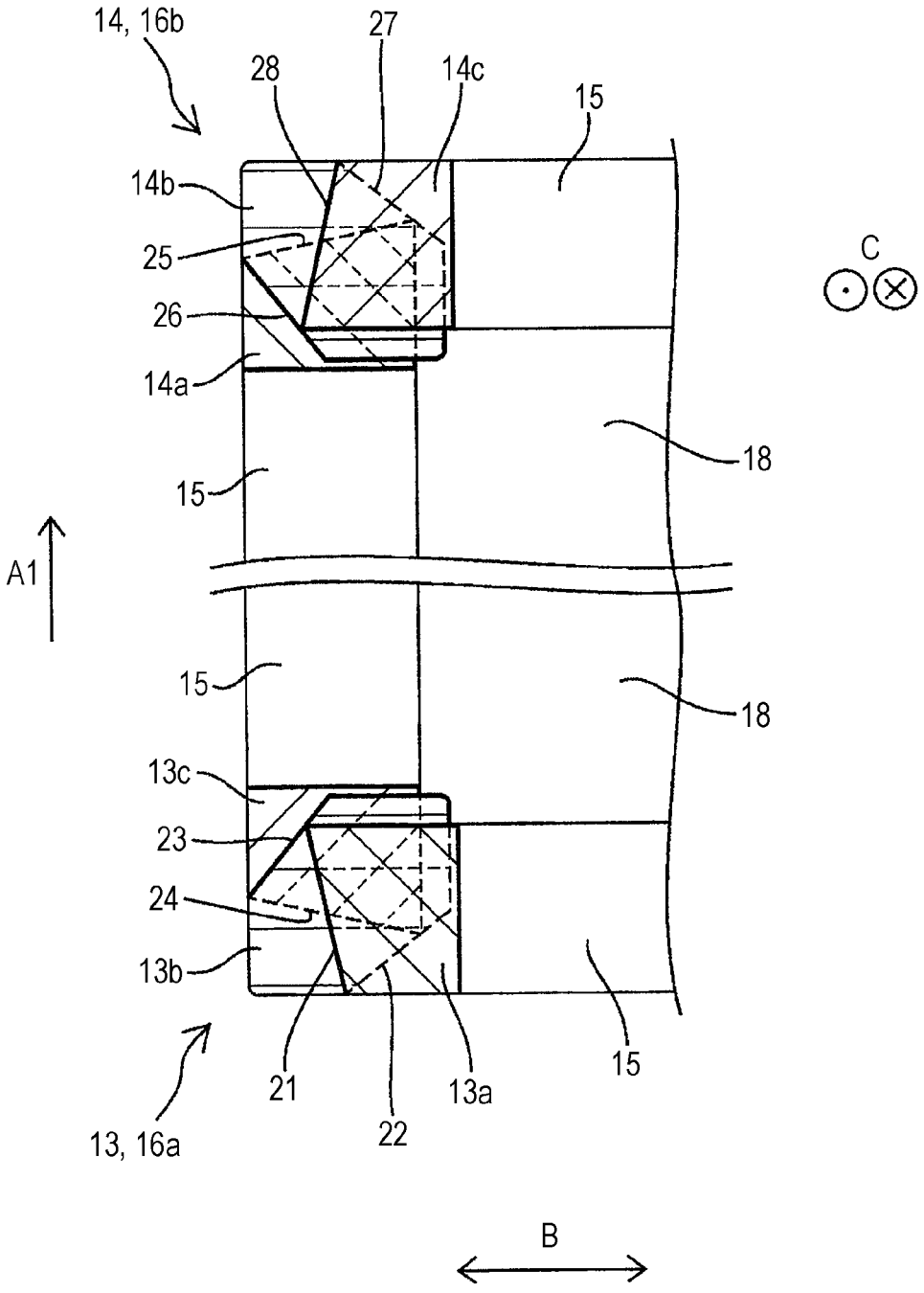
FIG. 7 is a schematic enlarged bottom view that represents a portion of the medium support unit that can be used by the printing apparatus according to the embodiment of the invention.
Figure 8:
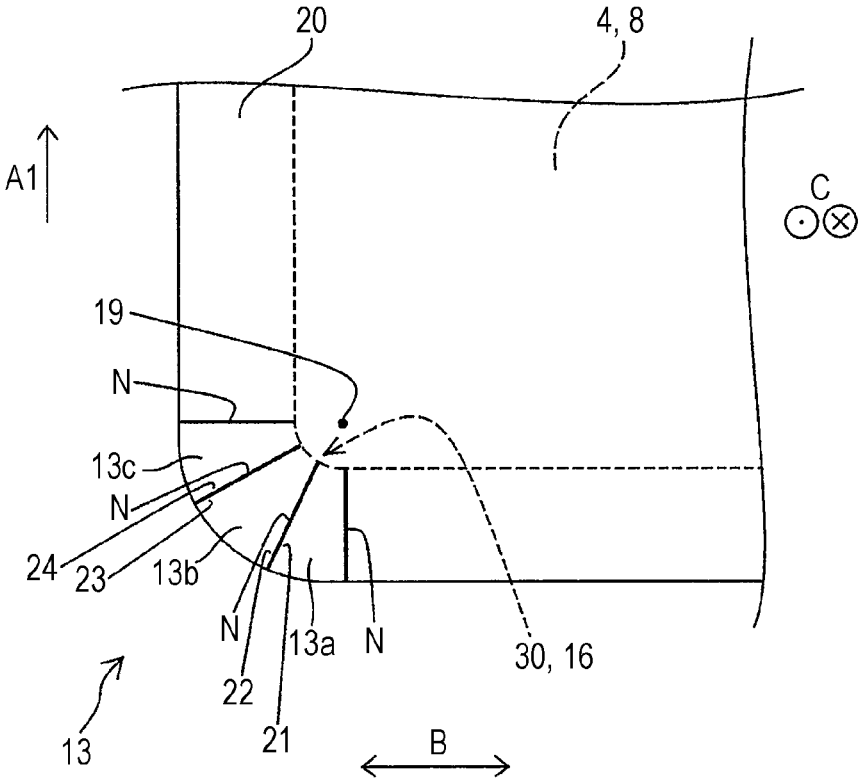
FIG. 8 is a schematic enlarged plan view that represents a portion of the medium support unit that can be used by the printing apparatus according to the embodiment of the invention.
Figure 9:
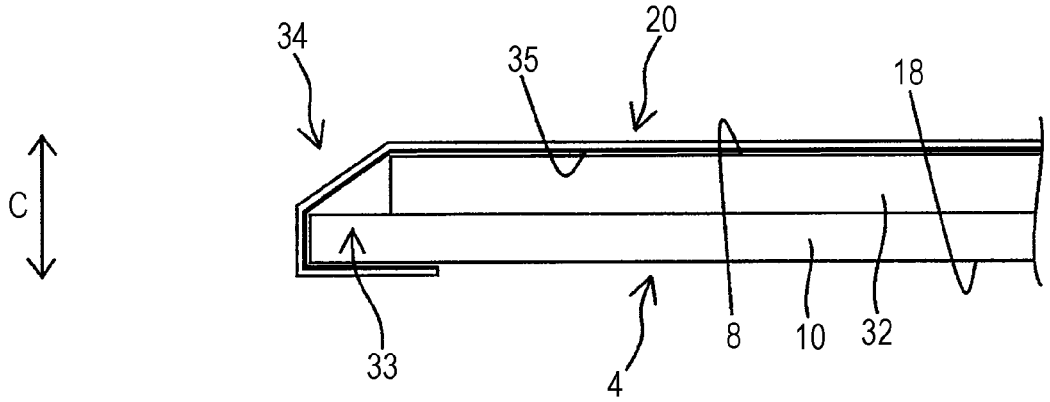
FIG. 9 is a schematic side surface cross-sectional view that represents a portion of the medium support unit that can be used by the printing apparatus according to the embodiment of the invention.

In this instance, FIG. 4 is a schematic plan view that shows the tray 4 as one of the constituent members that configure the medium support unit 2. In addition, FIG. 5 is a schematic plan view that shows the tray 4 and a friction member 20, and shows respective dispositions when the friction member 20 is attached (fitted) to the tray 4. In addition, FIG. 6 is a schematic bottom view that shows the tray 4 and the friction member 20, and shows a state in which the friction member 20 is attached (fitted) to the tray 4. In addition, FIG. 7 is a schematic enlarged bottom view that shows a portion of the tray 4 and the friction member 20, and shows a state in which the friction member 20 is attached to the tray 4. In addition, FIG. 8 is a schematic enlarged plan view that shows a portion of the tray 4 and the friction member 20, and shows respective dispositions when the friction member 20 is attached to the tray 4. Further, FIG. 9 is a schematic side surface cross-sectional view that shows a portion of the tray 4 and the friction member 20, and shows a state in which the friction member 20 is attached to the tray 4.

Figure 10:
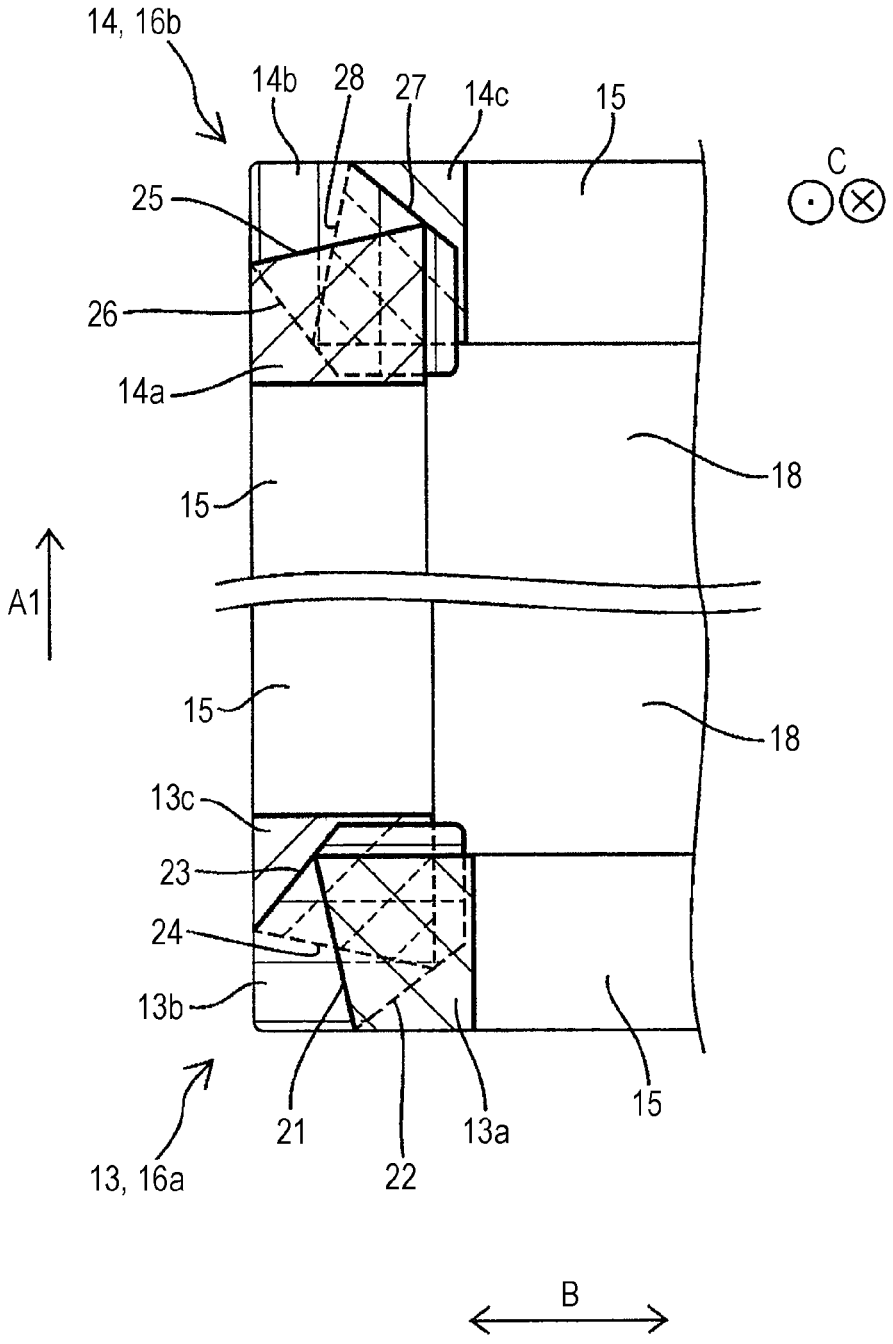
FIG. 10 is a schematic enlarged bottom view that represents a portion of the medium support unit that can be used by the printing apparatus according to the embodiment of the invention.

In addition, FIG. 10 is a schematic enlarged bottom view that shows a portion of the tray 4 and the friction member 20, is a view that corresponds to FIG. 7, and shows a state in which the friction member 20 is attached to the tray 4 using a different method to the state shown by FIG. 7.

Figure 11:
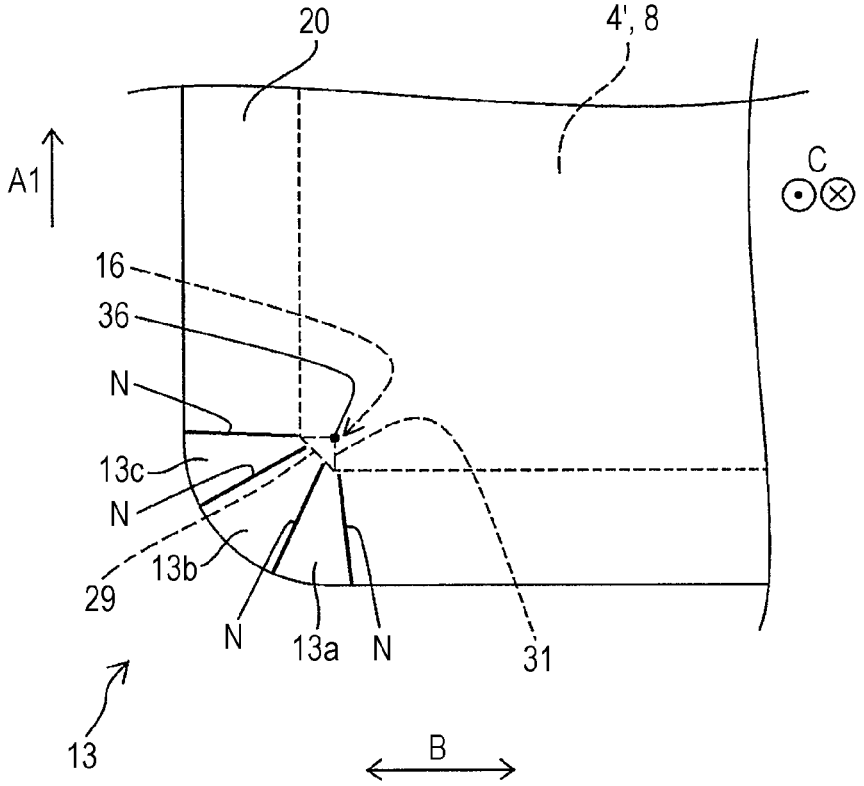
FIG. 11 is a schematic enlarged plan view that represents a portion of the medium support unit that can be used by the printing apparatus according to the embodiment of the invention.

In addition, FIG. 11 is a schematic enlarged plan view that corresponds to FIG. 8 in a case in which a tray 4', which can be used by the printing apparatus 1 (the medium support unit 2) of the present embodiment and has a shape that is different to that of the tray 4, is used.

As shown by FIG. 4, the tray 4 of the present embodiment constitutes a substantially rectangular form that is provided with four corner portions 16 (all arc-like corners) when viewed in a planar manner, or to explain in a more detailed manner, is provided with corner portions 16*a* that are further on the upstream side than the center in the setting direction A1 and corner portions 16*b* that are further on the downstream side than the center in the setting direction A1. In addition, a frame-bearing portion 10 is formed in a lower position than the support surface 8 so as to form a stepped portion 33 in the support surface 8 (refer to FIG. 9). As a result of surface, the tray 4 of the present embodiment has a configuration in which a medium is set on the support surface 8, and it is possible for a medium to be pressed (a medium to be fixed) onto the support surface 8 by placing a frame portion (not illustrated in the drawings) thereabove (above the position of the frame-bearing portion 10). In a case in which a medium that does not slide readily on the support surface 8 is used, or the like, the printing apparatus 1 of the present embodiment can suitably print an image on the medium by clamping the medium by the tray 4 (the frame-bearing portion 10) and the frame portion in this manner.

Meanwhile, in a case in which a medium that does slide readily on the support surface 8 is used, in place of using the frame portion, the printing apparatus 1 of the present embodiment can suitably print an image on the medium as a result of disposing the friction member 20 (a member having a higher static friction coefficient with respect to the medium than the support surface 8) in the tray 4. For example, it is possible to use a cloth as the friction member 20. In a case in which the support surface 8 is formed of a resin member, a cloth having a higher static friction coefficient with respect to a medium than the resin member may be used as the friction member 20. However, the member used as the friction member 20 need not necessarily be a cloth, and may be any kind of material as long as the material has a higher static friction coefficient with respect to the medium than the support surface 8.

It is possible to immobilize the medium with respect to the support surface 8 by disposing the friction member 20 in the tray 4. Additionally, in movement of a medium with respect to the support surface 8, there is a case in which a medium moves in an overall manner in one direction with respect to the support surface 8, and for example, a case in which a medium swells in an initial printing step when performing printing on the medium by using two steps and the medium moves (spreads) in all directions with respect to the support surface 8. Further, for example, when a medium swells in an initial printing step (for example, base printing using white ink) when performing printing on the medium by using two steps and the medium moves (spreads) in all directions with respect to the support surface 8, there are cases in which an image is shifted in a subsequent printing step (for example, base printing sections in white ink protrude from the image of the subsequent printing step).

As shown by FIG. 5, the friction member 20 that can be used by the printing apparatus 1 (the medium support unit 2) of the present embodiment constitutes a substantially rectangular form, and has two incision formation portions 13 and two incision formation portions 14 so as to correspond to the corner portions 16 of the tray 4. In each incision formation portion 13 of the present embodiment, a folded portion 13*a*, a folded portion 13*b*, and a folded portion 13*c* are formed in order from the upstream side in the setting direction A1 by four incisions N. In addition, in each incision formation portion 14 of the present embodiment, a folded portion 14*a*, a folded portion 14*b*, and a folded portion 14*c* are formed in order from the upstream side in the setting direction A1 by four incisions N. Further, in the friction member 20 of the present embodiment, folded portions 15 are formed between the incision formation portions 13, between the incision formation portions 14, and between the incision formation portions 13 and the incision formation portions 14. In this instance, each folded portion functions as a cover portion that covers the corner portions 16.

In this case, the respective dispositions during attachment (fitting) of the friction member 20 to the tray 4 are as shown in FIG. 5, the incision formation portions 13 correspond to the corner portions 16*a*, and the incision formation portions 14 correspond to the corner portions 16*b*. Further, after the respective components are disposed in this manner, as shown in FIG. 6, each of the folded portions 13*a*, the folded portions 13*b*, the folded portions 13*c*, the folded portions 14*a*, the folded portions 14*b*, the folded portions 14*c*, and the folded portions 15 is folded to a rear surface 18 of the tray 4.

In this instance, the folding sequence of the folded portions 13*a*, the folded portions 13*b*, and the folded portions 13*c* is an order of the folded portions 13*c*, the folded portions 13*b*, and the folded portions 13*a*. More specifically, firstly, the folded portions 13*c* are bent. Next, the folded portions 13*b* are bent so that end portions 23 of the folded portions 13*b* on the downstream side in the setting direction A1 cover end portions 24 of the folded portions 13*c* on the upstream side in the setting direction A1. Next, the folded portions 13*a* are bent so that end portions 21 of the folded portions 13*a* on the downstream side in the setting direction A1 cover end portions 22 of the folded portions 13*b* on the upstream side in the setting direction A1. As a result of folding in such an order, as shown in FIG. 7, the folded portions 13*b* are disposed so as to overlap on top of the folded portions 13*c*, and furthermore, the folded portions 13*a* are disposed so as to overlap on top of the folded portions 13*b*.

In summary, in the medium support unit 2 of the present embodiment, the medium support unit 2 of the present embodiment is a medium support unit that supports, on the support surface 8, a medium on which printing is to be performed by the printing apparatus 1, and is provided with the tray 4 that has the support surface 8 and on which it is possible to set the medium in the setting direction A1 that runs parallel to the support surface 8, and the friction member 20, which is a member having a higher static friction coefficient with respect to the medium than the support surface 8, and is attached to the tray 4 so as to cover the support surface 8. Further, the tray 4 has the corner portions 16 at which, when viewed from the support surface 8 side (in a planar manner), two different sides intersect, and the friction member 20 has, at positions that correspond to the corner portions 16, the incision formation portions 13 and 14 in which three or more of the incisions N are made.

In this instance, if description is given using the folded portions 13*b* and the folded portions 13*c*, the incision formation portions 13 that cover the corner portions 16*a* positioned further on the upstream side than the center in the setting direction A1 have the folded portions 13*b* as the first cover portions formed between adjacent incisions N, and the folded portions 13*c* as the second cover portions positioned further on the downstream side in the setting direction A1 than the folded portions 13*b* and formed between adjacent incisions N, and the end portions 23 of the folded portions 13*b* on the downstream side in the setting direction A1 are overlapped so as to cover the end portions 24 of the folded portions 13*c* on the upstream side in the setting direction A1.

That is, in the medium support unit 2 of the present embodiment, at the corner portions 16*a* positioned further on the upstream side in the setting direction A1 than the center, the end portions (the end portions 24 and the end portions 22 which will be mentioned later) of the cover portions (the folded portions 13*b* and the folded portions 13*c*), which are formed between incisions, on the upstream side in the setting direction A1 are covered. At the corner portions 16*a* positioned further on the upstream side than the center in the setting direction A1, a medium is likely to come into contact with the friction member 20 with a strong frictional force during setting of the medium in the tray 4, and therefore, the end portions of the cover portions, which are formed between incisions, on the upstream side in the setting direction A1 are particularly likely to become caught or separated due to the medium moving in the setting direction A1. However, as a result of adopting such a configuration, the end portions of the friction member 20 are unlikely to become caught on a medium even if the medium is moved in the setting direction A1. Therefore, the medium support unit 2 of the present embodiment has a configuration in which it is possible to firmly fix a medium to the tray 4 by the friction member 20 and it is possible to prevent the friction member 20 from becoming separated during setting of the medium in the tray 4.

In this instance, rather than referring exclusively to directly causing a medium to be supported on the support surface 8, the term "supports on the support surface 8" has a meaning that includes disposing another member, or the like, (the friction member 20, or the like) on the support surface 8 and indirectly (without coming into direct contact) supporting a medium. The support surface 8 of the present embodiment indirectly supports a medium via at least the friction member 20.

In addition, the term "corner portion" has a meaning that includes arc-like corners (round corners) and portions on which chamfering has been carried out.

Additionally, the above-mentioned description was given using the folded portions 13*b* and the folded portions 13*c*, but it is also possible to describe the configuration using the folded portions 13*a* and the folded portions 13*b*. More specifically, the incision formation portions 13 that cover the corner portions 16*a* positioned further on the upstream side than the center in the setting direction A1 have the folded portions 13*a* as the first cover portions formed between adjacent incisions N, and the folded portions 13*b* as the second cover portions positioned further on the downstream side in the setting direction A1 than the folded portions 13*a* and formed between adjacent incisions N, and the end portions 21 of the folded portions 13*a* on the downstream side in the setting direction A1 are overlapped so as to cover the end portions 22 of the folded portions 13*b* on the upstream side in the setting direction A1.

In this instance, if the above-mentioned configuration is described from a different viewpoint, the configuration can be described as an attachment method of the friction member 20 in the medium support unit 2 that supports, on the support surface 8, a medium on which printing is to be performed by the printing apparatus 1, the unit being provided with the tray 4 that has the support surface 8 and on which it is possible to set the medium in the setting direction A1 that runs parallel to the support surface 8, and the friction member 20, which is a member having a higher static friction coefficient with respect to the medium than the support surface 8 and is attached to the tray 4 so as to cover the support surface 8, in which the tray 4 has the corner portions 16 at which, when viewed from the support surface 8 side, two different sides intersect, and the friction member 20 has, at positions that correspond to the corner portions 16, the incision formation portions 13 and 14 in which three or more of the incisions N are made. The attachment method of the friction member 20 is an attachment method in which, when covering the corner portions 16*a* positioned further on the upstream side than the center in the setting direction A1 by using the incision formation portions 13 of the friction member 20, the end portions (the end portions 23 and the end portions 21) of the first cover portions, which are formed between adjacent incisions N, on the downstream side in the setting direction A1 are overlapped so as to cover the end portions (the end portions 24 and the end portions 22) of the second cover portions, which are positioned further on the downstream side in the setting direction A1 than the first cover portions and formed between adjacent incisions N, on the upstream side in the setting direction A1.

That is, in such an attachment method of the friction member 20, at the corner portions 16*a* positioned further on the upstream side in the setting direction A1 than the center, the end portions (the end portions 24 and the end portions 22) of the cover portions (the folded portions 13*b* and the folded portions 13*c*), which are formed between incisions, on the upstream side in the setting direction A1 are covered. At the corner portions 16*a* positioned further on the upstream side than the center in the setting direction A1, a medium is likely to come into contact with the friction member 20 with a strong frictional force during setting of the medium in the tray 4, and therefore, the end portions (the end portions 24 and the end portions 22) of the cover portions, which are formed between incisions, on the upstream side in the setting direction A1 are particularly likely to become caught or separated due to the medium moving in the setting direction A1. However, as a result of the friction member 20 being attached by using such a method, the end portions of the friction member 20 are unlikely to become caught on a medium even if the medium is moved in the setting direction A1. Therefore, it is possible to firmly fix a medium to the tray 4 by the friction member 20 and it is possible to prevent the friction member 20 from becoming separated during setting of the medium in the tray 4.

In this instance, if the above-mentioned configuration is described from a different viewpoint, the printing apparatus 1 of the present embodiment is provided with the medium support unit 2 and the printing head 7 as a printing section that performs printing on the medium supported by the medium support unit 2. Therefore, the printing apparatus 1 of the present embodiment has a configuration in which it is possible to print with a medium firmly fixed to the tray 4 by the friction member 20 and it is possible to prevent the friction member 20 from becoming separated during setting of the medium in the tray 4.

While the folding sequence of the folded portions 13*a*, the folded portions 13*b*, and the folded portions 13*c* is as mentioned above, and the folding sequence of the folded portions 14*a*, the folded portions 14*b*, and the folded portions 14*c* is an order of the folded portions 14*a*, the folded portions 14*b*, and the folded portions 14*c*. More specifically, firstly, the folded portions 14*a* are bent. Next, the folded portions 14*b* are bent so that end portions 26 of the folded portions 14*b* on the upstream side in the setting direction A1 cover end portions 25 of the folded portions 14*a* on the downstream side in the setting direction A1. Next, the folded portions 14*c* are bent so that end portions 28 of the folded portions 14*c* on the upstream side in the setting direction A1 cover end portions 27 of the folded portions 14*b* on the downstream side in the setting direction A1. As a result of folding in such an order, as shown in FIG. 7, the folded portions 14*b* are disposed so as to overlap on top of the folded portions 14*a*, and furthermore, the folded portions 14*c* are disposed so as to overlap on top of the folded portions 14*b*.

In this instance, if description is given using the folded portions 14*a* and the folded portions 14*b*, the incision formation portions 14 that cover the corner portions 16*b* positioned further on the downstream side than the center in the setting direction A1 have the folded portions 14*a* as the third cover portions formed between adjacent incisions N, and the folded portions 14*b* as the fourth cover portions positioned further on the downstream side in the setting direction A1 than the folded portions 14*a* and formed between adjacent incisions N, and the end portions 26 of the folded portions 14*b* on the upstream side in the setting direction A1 are overlapped so as to cover the end portions 25 of the folded portions 14*a* on the downstream side in the setting direction A1.

That is, in the medium support unit 2 of the present embodiment, the configuration of the incision formation portions 13 and 14 is symmetric in the setting direction A1 with the center in the setting direction A1 as a reference (refer to FIGS. 6 and 7). Therefore, in a case in which the support portion is constituted having a symmetrical structure in the setting direction A1, or the like, in the manner of the tray 4 of the present embodiment, regardless of the direction in which the support portion is set in the setting direction A1 (even if the support portion is set with the upstream side and the downstream side reversed), it is possible to firmly fix a medium to the support portion by the friction member 20 and it is possible to prevent the friction member 20 from becoming separated during setting of the medium in the support portion.

Additionally, the above-mentioned description was given using the folded portions 14*a* and the folded portions 14*b*, but it is also possible to describe the configuration using the folded portions 14*b* and the folded portions 14*c*. More specifically, the incision formation portions 14 that cover the corner portions 16*b* positioned further on the downstream side than the center in the setting direction A1 have the folded portions 14*b* as the third cover portions formed between adjacent incisions N, and the folded portions 14*c* as the fourth cover portions positioned further on the downstream side in the setting direction A1 than the folded portions 14*b* and formed between adjacent incisions N, and the end portions 28 of the folded portions 14*c* on the upstream side in the setting direction A1 are overlapped so as to cover the end portions 27 of the folded portions 14*b* on the downstream side in the setting direction A1.

However, the configuration of the incision formation portions 14 that cover the corner portions 16*b* positioned further on the downstream side than the center in the setting direction A1 is not limited to the above-mentioned configuration that is shown by FIG. 7. For example, a configuration such as that shown by FIG. 10 may also be used. In the configuration of FIG. 10, the folding sequence of the folded portions 14*a*, the folded portions 14*b*, and the folded portions 14*c* is the reverse of that of the configuration of FIG. 7. That is, the folding sequence in the incision formation portions 14 is an order of the folded portions 14*a*, the folded portions 14*b*, and the folded portions 14*c*. More specifically, firstly, the folded portions 14*c* are bent. Next, the folded portions 14*b* are bent so that the end portions 27 of the folded portions 14*b* on the downstream side in the setting direction A1 cover the end portions 28 of the folded portions 14*a* on the upstream side in the setting direction A1. Next, the folded portions 14*a* are bent so that the end portions 25 of the folded portions 14*a* on the downstream side in the setting direction A1 cover the end portions 26 of the folded portions 14*b* on the upstream side in the setting direction A1. As a result of folding in such an order, as shown in FIG. 10, the folded portions 14*b* are disposed so as to overlap on top of the folded portions 14*c*, and furthermore, the folded portions 14*a* are disposed so as to overlap on top of the folded portions 14*b*.

If description is given using the folded portions 14*a* and the folded portions 14*b*, as shown in FIG. 10, the incision formation portions 14 that cover the corner portions 16*b* positioned further on the downstream side than the center in the setting direction A1 have the folded portions 14*a* as the third cover portions formed between adjacent incisions N, and the folded portions 14*b* as the fourth cover portions positioned further on the downstream side in the setting direction A1 than the folded portions 14*a* and formed between adjacent incisions N, and the end portions 25 of the folded portions 14*a* on the downstream side in the setting direction A1 are overlapped so as to cover the end portions 26 of the folded portions 14*b* on the upstream side in the setting direction A1. As a result of adopting such a configuration, at the corner portions 16*b* positioned further on the downstream side than the center in the setting direction A1, it is also possible to effectively prevent the friction member 20 from becoming separated during setting of a medium in the tray 4.

Additionally, the above-mentioned description was given using the folded portions 14*a* and the folded portions 14*b*, but it is also possible to describe the configuration using the folded portions 14*b* and the folded portions 14*c*. More specifically, as shown in FIG. 10, the incision formation portions 14 that cover the corner portions 16*b* positioned further on the downstream side than the center in the setting direction A1 have the folded portions 14*b* as the third cover portions formed between adjacent incisions N, and the folded portions 14*c* as the fourth cover portions positioned further on the downstream side in the setting direction A1 than the folded portions 14*b* and formed between adjacent incisions N, and the end portions 27 of the folded portions 14*b* on the downstream side in the setting direction A1 are overlapped so as to cover the end portions 28 of the folded portions 14*c* on the upstream side in the setting direction A1.

In addition, as shown in FIG. 9, in the friction member 20 of the present embodiment, double sided tape 35 is pasted onto the entire surface of a side that is brought into contact with the tray 4. The friction member 20 has a configuration that is fixed to the tray 4 in an attachable and detachable manner by using the double sided tape 35.

In other words, the double sided tape 35 is provided in the tray 4 of the present embodiment as a fixing portion that fixes the friction member 20 in an attachable and detachable manner. Therefore, the medium support unit 2 of the present embodiment has a configuration in which it is possible to easily perform cleaning and replacement of the friction member 20 by attaching and detaching the friction member 20.

Additionally, in the medium support unit 2 of the present embodiment, the double sided tape 35 is provided as the fixing portion, but the fixing portion is not limited to double-sided tape. For example, it is possible to use a surface fastener, a clip, a hook, a surface fastener, and the like.

In this instance, it is preferable that the fixing portion be provided on the rear surface 18 on the side opposite to the support surface 8. In particular, the reason for this is that, in a case in which a clip, a hook, a snap fastener, or the like, is used as the fixing portion, it is possible to make it more likely that a medium becoming caught and the friction member 20 becoming separated are prevented at the fixing portion, in the vicinity of the fixing portion, or the like.

Additionally, the term "provided to the rear surface 18" has a meaning that includes a configuration in which the fixing portion is provided throughout an area from the support surface 8 to the rear surface 18 in the manner of the present embodiment.

In addition, as shown in FIG. 4, a stepped portion 33, for bearing a frame portion that presses a medium and which is formed by making a step in the support surface 8, is formed in the tray 4 of the present embodiment in the periphery of the support surface 8. As shown in FIG. 9, the stepped portion 33 is formed by a support surface formation portion 32, on which the support surface 8 is formed, and the frame-bearing portion 10. Further, as shown in FIG. 9, the friction member 20 covers the stepped portion 33 in a manner in which an inclined surface 34 is formed above the stepped portion 33.

In this manner, as a result of the stepped portion 33 for bearing the frame portion that presses a medium, being formed in the 4 in at least one portion of the periphery of the support surface 8, it is possible to use the frame portion that presses a medium according to necessity. In addition, the inclined surface 34 is formed in the periphery of the support surface 8 as a result of the friction member 20 covering the stepped portion 33 so that the inclined surface 34 is formed above the stepped portion 33. The periphery of the support surface 8 is an area in which a medium is likely to rise from the tray 4, but the medium support unit 2 of the present embodiment has a configuration in which it is possible to prevent rising as a result of the inclined surface 34 being formed in the periphery of the support surface 8 is used. As a result of preventing rising, it is possible to prevent contact between a medium (a risen section) and the printing head 7 during printing.

In addition, as shown in FIG. 8, the incision formation portions 13 of the present embodiment is formed as a result of the incisions N being made in a radial manner. As a result of adopting such a configuration, it is possible to form a configuration in which the end portions (the end portions 23 and the end portions 21) of the first cover portions on the downstream side in the setting direction A1 overlap so as to cover the end portions (the end portions 24 and the end portions 22) of the second cover portions on the upstream side in the setting direction. Additionally, as shown in FIG. 5, in the same manner as the incision formation portions 13, the incision formation portions 14 are formed as a result of the incisions N being made in a radial manner.

In this instance, the term "the incisions N are made in a radial manner" refers to a configuration in which the respective intervals between the incisions N narrows toward a central side from an edge side of the friction member 20. For example, a configuration such as that shown by FIG. 8 in which the incisions N are made toward a center 19 of an arc in a case in which the corner portions 16 are arc-like corners 30 is an example of such a configuration. In addition, a configuration such as that shown by FIG. 11 in which the incisions N are made toward an apex 36 of a right angled triangle 31 in which a surface 29 on which chamfering has been carried out is configured to be a bottom side in a case in which the corner portions 16 have a chamfered shaped.

Additionally, the invention is not limited to the above-mentioned embodiment, various modifications are possible within the scope of the invention disclosed in the claims, and, naturally, such alterations are also included within the scope of the invention.

In the above-mentioned embodiment, a configuration in which there are three (four incisions N) folded portions in the incision formation portions 13 and 14 is used, but a configuration in which there are two or four or more folded portions may also be used.

This application claims priority under 35 U.S.C. § 119 to Japanese Patent Application No. 2017-033551, filed Feb. 24, 2017. The entire disclosure of Japanese Patent Application No. 2017-033551 is hereby incorporated herein by reference.

What is claimed is:

1. A medium support unit that supports, on a support surface, a medium on which printing is to be performed by a printing apparatus, the medium support unit comprising:

a support portion that has the support surface and on which it is possible to set the medium in a setting direction that runs parallel to the support surface; and a friction member, which is a member having a higher static friction coefficient with respect to the medium than the support surface and is attached to the support portion to cover the support surface, wherein the support portion has a corner portion at which, when viewed from the support surface side, two different sides intersect, the friction member has, at a position that corresponds to the corner portion, an incision formation portion in which three or more incisions are made, the incision formation portion that covers the corner portion positioned further on an upstream side than a center in the setting direction has a first cover portion formed between adjacent incisions, and a second cover portion positioned further on a downstream side in the setting direction than the first cover portion and formed between adjacent incisions, and the first cover portion overlaps with the second cover portion such that an end portion of the first cover portion on the downstream side in the setting direction covers an end portion of the second cover portion on the upstream side in the setting direction.

2. The medium support unit according to claim 1, wherein the incision formation portion that covers the corner portion positioned further on the downstream side than the center in the setting direction has a third cover portion formed between adjacent incisions, and a fourth cover portion positioned further on the downstream side in the setting direction than the third cover portion and formed between adjacent incisions, and the fourth cover portion overlaps with the third cover portion such that an end portion of the fourth cover portion on the upstream side in the setting direction covers an end portion of the third cover portion on the downstream side in the setting direction.

3. The medium support unit according to claim 1, wherein the incision formation portion that covers the corner portion positioned further on the downstream side than the center in the setting direction has a third cover portion formed between adjacent incisions, and a fourth cover portion positioned further on the downstream side in the setting direction than the third cover portion and formed between adjacent incisions, and the third cover portion overlaps with the fourth cover portion such that an end portion of the third cover portion on the downstream side in the setting direction covers an end portion of the fourth cover portion on the upstream side in the setting direction.

4. The medium support unit according to claim 1, wherein a fixing portion that fixes the friction member in an attachable and detachable manner is provided to the support portion.

5. The medium support unit according to claim 4, wherein the fixing portion is provided on a rear surface opposite to the support surface.

6. The medium support unit according to claim 1, wherein the incision formation portion is formed by making incisions in a radial manner.

7. The medium support unit according to claim 1, wherein a stepped portion is formed in at least one portion of the support portion in the periphery of the support surface by making a step in the support surface in order to bear a frame portion that presses the medium, and the friction member covers the stepped portion in such a way that an inclined surface is formed above the stepped portion.

8. A printing apparatus comprising:

the medium support unit according to claim 1; and a printing section that performs printing on the medium supported by the medium support unit.

9. A printing apparatus comprising:

the medium support unit according to claim 2; and a printing section that performs printing on the medium supported by the medium support unit.

10. A printing apparatus comprising:

the medium support unit according to claim 3; and a printing section that performs printing on the medium supported by the medium support unit.

11. A printing apparatus comprising:

the medium support unit according to claim 4; and a printing section that performs printing on the medium supported by the medium support unit.

12. A printing apparatus comprising:

the medium support unit according to claim 5; and a printing section that performs printing on the medium supported by the medium support unit.

13. A printing apparatus comprising:

the medium support unit according to claim 6; and a printing section that performs printing on the medium supported by the medium support unit.

14. A printing apparatus comprising:

the medium support unit according to claim 7; and a printing section that performs printing on the medium supported by the medium support unit.

15. An attachment method of a friction member in a medium support unit that supports, on a support surface, a medium on which printing is to be performed by a printing apparatus, the medium support unit being provided with a support portion that has the support surface and on which it is possible to set the medium in a setting direction that runs parallel to the support surface, and a friction member, which is a member having a higher static friction coefficient with respect to the medium than the support surface and is attached to the support portion to cover the support surface, in which the support portion has a corner portion at which, when viewed from the support surface side, two different sides intersect, and the friction member has, at a position that corresponds to the corner portion, an incision formation portion in which three or more incisions are made, the method comprising:

when covering the corner portion positioned further on the upstream side than the center in the setting direction by the incision formation portion of the friction member, overlapping a first cover portion formed between adjacent incisions with a second cover portion positioned further on the downstream side in the setting direction than the first cover portion and formed between adjacent incisions such that an end portion of the first cover portion on the downstream side in the setting direction covers an end portion of the second cover portion on the upstream side in the setting direction.

* * * * *